US007322216B2

(12) United States Patent
Favret et al.

(10) Patent No.: US 7,322,216 B2
(45) Date of Patent: Jan. 29, 2008

(54) WASHING AID DISPENSER AND WASHING MACHINE COMPRISING SAID DISPENSER

(75) Inventors: Ugo Favret, Casarsa (IT); Silvano Cimetta, Treviso (IT)

(73) Assignee: Electrolux Home Products Corporation N.V., Zaventem (BE)

( * ) Notice: Subject to any disclaimer, the term of this patent is extended or adjusted under 35 U.S.C. 154(b) by 518 days.

(21) Appl. No.: 10/507,930

(22) PCT Filed: Feb. 17, 2003

(86) PCT No.: PCT/EP03/01555

§ 371 (c)(1),
(2), (4) Date: Sep. 17, 2004

(87) PCT Pub. No.: WO03/078357

PCT Pub. Date: Sep. 25, 2003

(65) Prior Publication Data

US 2005/0166645 A1 Aug. 4, 2005

(30) Foreign Application Priority Data

Mar. 19, 2002 (IT) ..... PN2002A0016

(51) Int. Cl.
*D06F 39/02* (2006.01)

(52) U.S. Cl. ..... 68/17 R; 222/132

(58) Field of Classification Search ..... 68/17 R; 222/132

See application file for complete search history.

(56) References Cited

U.S. PATENT DOCUMENTS

| | | | | |
|---|---|---|---|---|
| 3,501,057 | A * | 3/1970 | Binnings | 222/132 |
| 6,826,933 | B2 * | 12/2004 | Merkle et al. | 68/17 R |
| 2004/0172770 | A1 * | 9/2004 | Heo et al. | 8/158 |

FOREIGN PATENT DOCUMENTS

| | | | |
|---|---|---|---|
| DE | 3714301 | A1 | 11/1988 |
| EP | 0225220 | A1 | 6/1987 |
| GB | 2187764 | A * | 9/1987 |

* cited by examiner

*Primary Examiner*—Michael Barr
*Assistant Examiner*—Jason P. Riggleman
(74) *Attorney, Agent, or Firm*—Wenderoth, Lind & Ponack, L.L.P.

(57) ABSTRACT

A washing aid dispenser for a washing machine comprises at least a compartment, which is adapted to contain washing aids and is provided with a first siphon having a predetermined suction height and at least a second siphon having a higher suction height than the first siphon. The first and the second siphon are adapted to draw in and convey towards a washing tub of the machine layers of the washing aids mixed with water lying at different heights in the dispenser.

11 Claims, 2 Drawing Sheets

WASHING AID DISPENSER AND WASHING MACHINE COMPRISING SAID DISPENSER

The present invention refers to a dispenser of washing products and aids, such as detergents or whiteners, fabrics softeners, scents and similar aids, for use in connection with a washing machine, such as a clothes washing machines.

It is largely known that these products and substances are poured by a user into specially provided compartments of the dispenser before the machine is started, and are thereafter introduced from such a dispenser into a washing tub of the machine at pre-established times and phases of a washing cycle being performed. Currently used detergent dispensers are generally provided as a single-piece component part comprising at least two distinct compartments adapted to receive and hold washing powders or liquids on one side and, on another side, generally liquid rinsing aids. For transferring liquid substances from the dispenser into the washing tub of the machine, one or more siphons are usually provided within a compartment or compartments containing such substances. Inflow of water into the dispenser during a phase of a washing cycle that calls for liquid substances to be introduced into the washing tub causes, upon reaching a necessary water head, a siphon to be triggered, i.e. primed into working and, as a result, a liquid detergent substance to be drawn in from the dispenser towards the washing tub is duly mixed with inflowing water.

DE 37 14 301 A1 discloses a plurality of syphon blocks, formed from a small standpipe and a cap, arranged in a washing-agent flush-in tray in such a way that, if one syphon fails to suck up the mixture consisting of washing-agent and water, the other syphons continue to work.

A typical drawback which is encountered with currently used types of dispensers lies in the fact that the siphon must work with liquids of different densities (water and liquid washing aid, e.g. a fabric softener), which do not mix very well, i.e. homogeneously together, but, owing to a flow pattern that is brought about inside the dispenser, tend to rather take a stratified or layered form, without any clear separation between water and washing substance. Such a layer-forming mixing of water and washing aid causes the siphon to work in a discontinuous manner, in which water is drawn in preferentially with respect to the washing aid. As a result, it quite often occurs that, upon conclusion of a washing cycle performed by the machine, remnants of denser washing aids or products, such as for instance the fabric softener, can still be found on a bottom of respective compartments in the dispenser.

Such a drawback might be overcome through an increase in inflow pressure of water supplied to the dispenser, but this would unavoidably give rise to excessive frothing during mixing with a liquid detergent substance so as to anyway cause the siphon to work irregularly or, in a worst case, lead to suds flowing over the dispenser and cause much inconvenience.

Another possible solution in this connection lies in increasing negative pressure generated by the siphon so as to obtain a greater draw-in capability. This solution, however, implies an increase in overall size of the siphon and, as a result, it turns out to be scarcely practicable due to construction-related limitations imposed by a machine requiring extremely reduced sizes in general.

It therefore is a main purpose of the present invention to do away with the above-mentioned drawbacks of prior-art solutions by providing a washing aid dispenser for washing machines, which is capable of working in an optimum manner with liquids of different densities, even if they do not mix homogeneously together inside the dispenser itself.

Within such a general scope of the invention, a further purpose is to provide a washing aid dispenser which is capable of ensuring complete removal, i.e. suction of liquid washing substances into a washing tub of a machine during pre-determined phases of a washing cycle, as well as complete removal of any remnant of the washing substances from a bottom of respective compartments in the dispenser at an end of the washing cycle.

Another major purpose of the present invention is to provide a washing aid dispenser which is capable of reaching the above-specified aims in a manner that is fully reliable and safe for a user, in particular without giving rise to any excessive frothing, i.e. formation of foam inside the dispenser itself.

A further major purpose yet of the present invention is to provide a washing aid dispenser which is capable of reaching the above-specified aims while keeping sizes and space requirements in general unaltered or, anyway, substantially within due limits, so as to meet construction-related limitations imposed by the machine.

A last, but not least purpose of the present invention is to provide a washing aid dispenser which is low in terms of cost and capable of being manufactured with use of existing, readily available materials, techniques and machinery.

According to the present invention, these aims and advantages, along with further ones that will become apparent from the following description, are reached in a washing aid dispenser for washing machines incorporating characteristics as recited and defined in the appended claims.

Features and advantages of the present invention may be more readily understood from description of some preferred, although not sole, embodiments that is given below by way of non-limiting examples with reference to the accompanying drawings, in which:

BRIEF DESCRIPTION OF THE DRAWINGS

FIG. 2(*a*) is a partial schematic cross-sectional view of an alternative washing aid dispenser showing a second conduit to be larger in diameter than a first conduit.

DETAILED DESCRIPTION OF THE PREFERRED EMBODIMENTS

Figure 1:
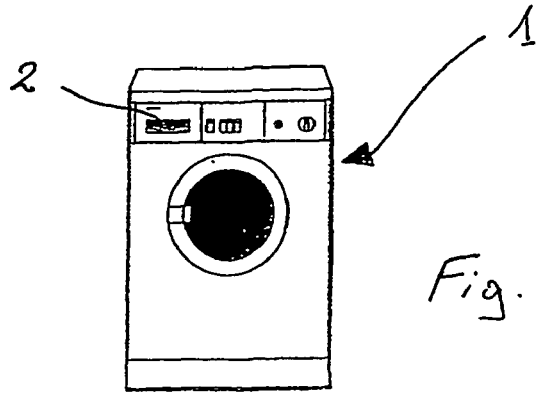
FIG. 1 is a schematic front view of a washing machine incorporating a washing aid dispenser according to the present invention.

With reference to FIG. 1 cited above, reference numeral 1 is used to generally indicate a washing machine, such as a clothes washing machine, incorporating a washing aid dispenser 2, which is adapted to be pulled out of a main body of the washing machine 1 itself so as to enable a user to fill detergent substances, such as washing powders or liquids, fabric softeners, whiteners, scents and similar aids, into respective compartments before starting the washing machine to go through a selected washing cycle.

The washing aid dispenser 2 comprises at least a compartment 3 adapted to contain detergent substances, in particular such aids as fabric softeners, which is in communication with water supply structure 4 adapted to deliver water coming from the machine 1. This water supply structure 4 is provided with a water inlet conduit 5, through which water, in certain phases of a washing cycle, is let into a chamber 6 and, through a plurality of apertures 7, is able to flow into the dispenser 2 so as to mix with the detergent substance contained inside the dispenser itself and, thereafter, convey a resulting mixture towards a washing tub of the machine 1. Arrows A and B indicate a flowpath followed by the water, whereas a water+softener mixture is conveyed into the washing tub along a path indicated by arrow C.

The washing aid dispenser further comprises a first siphon 8 adapted to draw in the above mentioned mixture from the dispenser and convey it towards the washing tub of the machine. In this exemplified embodiment, such a siphon is formed by a first conduit 9, which is open at both its opposite ends and is associated with a first cap piece 10 situated thereabove. Suction, i.e. a drawing-in action starts as soon as water flowing into the dispenser 2 reaches a level, i.e. a head required to prime or trigger the siphon 8 into working, with the level or head being defined by a distance of inner summit 11 of the first cap piece 10 to a bottom 12 of the dispenser 2, whereas suction height h is on the contrary defined by a distance of a base of the first cap piece 10, or a mouth, and the bottom 12 of the dispenser 2.

A peculiar feature of the present invention lies in the fact that the washing aid dispenser 2 is provided with at least a second siphon 14, which is in turn formed by a second conduit 15 which is open at both ends thereof and is associated with a second cap piece 16 situated thereabove. This second siphon 14 has a suction height H that is differentiated with respect to the suction height of the first siphon 8. With reference to the particular embodiment illustrated in FIG. 2, suction height H of the second siphon 14 is greater than suction height h of the first siphon 8.

Figure 2X:
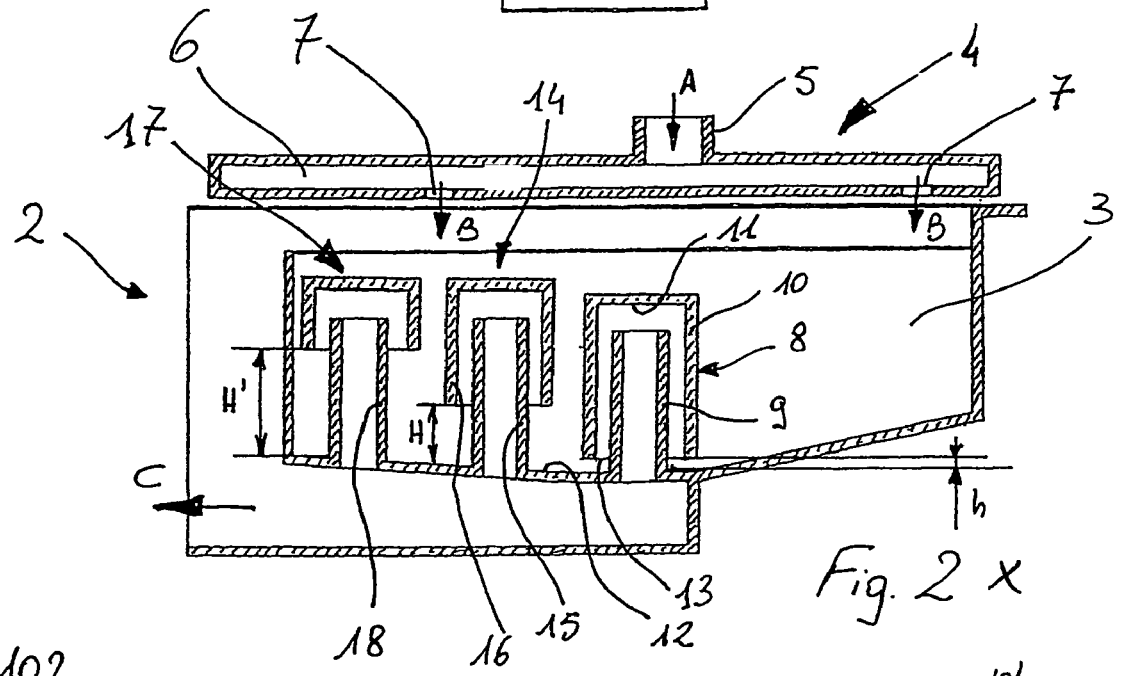
FIG. 2 is a longitudinal-sectional view of a first embodiment of the washing aid dispenser according to the present invention.
Figure 2A:
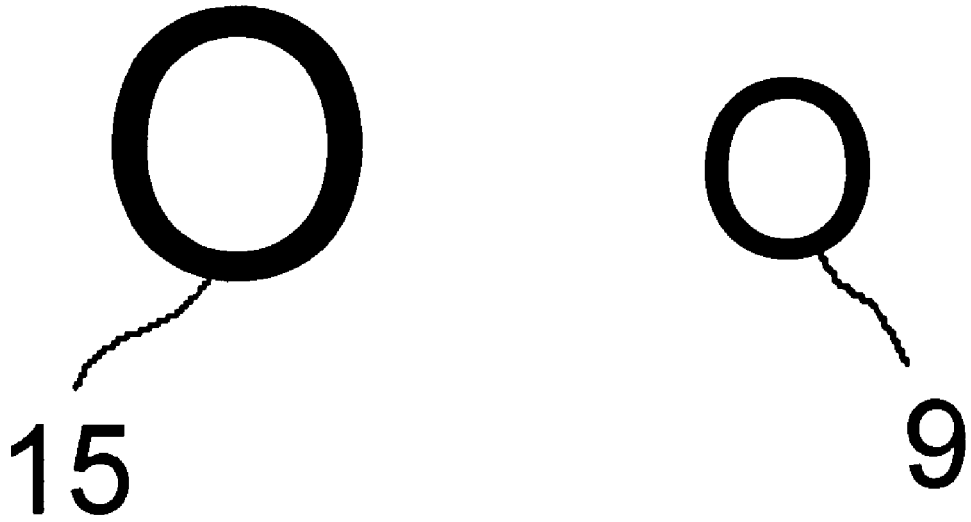

Advantageously, even a level or height of a water head of the second siphon 14 may be selected to be greater than that of the first siphon 8 and, possibly, also a diameter of the second conduit 15 may be selected to be larger than a diameter of the first conduit 9 as shown in FIG. 2(*a*).

According to a preferred embodiment of the present invention, which is exemplified in the illustration appearing in FIG. 2, there may also be provided a third siphon 17, formed by a third conduit 18 and a third cap piece 19 arranged thereabove. The third siphon 17 has a suction height H' that is greater than suction height H of said second siphon 14, and therefor, the level of a water head in the third siphon 17 may be substantially equal to that of the second siphon 14, as illustrated in FIG. 2, or even higher than that. It has in fact been found experimentally that such a contrivance proves effective in enabling the siphons 8, 14, 17 to be primed, i.e. triggered into working in a sequence, thereby improving an overall operation and efficiency during suction. In particular, this is effective in avoiding a risk that two contiguous siphons may unprime or deactivate each other.

Operation is as follows: as soon as water is let into the washing aid dispenser 2 through the apertures 7, it starts to mix with fabric softener, or such other washing aid as may be actually present in the dispenser, and to form the afore mentioned stratified water+softener mixture. When a water level rises above the inner summit 11 of the first siphon 8, the latter is primed, i.e. triggered into working, and the water+softener mixture starts to be drawn-in and conveyed towards the washing tub of the machine. As the water level continues to rise, even the second siphon 14 and, if provided, the third siphon 17 are primed and triggered into working. A suction action of these siphons takes place at different levels of the washing aid dispenser 2, so that various layers of the above mentioned stratified water+softener mixture that lie at different heights in the dispenser 2 are thereby able to be effectively drawn in and conveyed into the washing tub.

From the above description it can therefore be readily appreciated that the washing aid dispenser according to the present invention is actually able to fully reach the aforestated aims and provide desired advantages. In fact, provision of an additional siphon having a different suction height with respect to the first siphon 8 (or draining siphon) enables the stratified water+softener mixture to be drawn in at different heights with respect to the bottom 12 of the dispenser 2, so that a problem connected to such a stratification of the mixture owing to different densities of these two liquids can be effectively overcome.

In this manner, both suction and conveyance of the mixture occur in an optimum manner, notwithstanding a lack of homogeneity of the mixture itself, thereby ensuring both full suction of fabric softener during an appropriate phase of a washing cycle and full removal of any residue thereof from the bottom of the dispenser. Conclusively, this twofold advantage is achieved of a more rational and efficient utilization of detergent substances and an enhanced cleanliness of the washing aid dispenser.

It should furthermore be noticed how initially proposed advantages are actually achieved by keeping operating pressures of water and an overall size of the dispenser substantially unaltered.

It shall be appreciated that the above described washing aid dispenser may be the subject of a number of modifications and variants without departing from the scope of the present invention.

Figure 3:
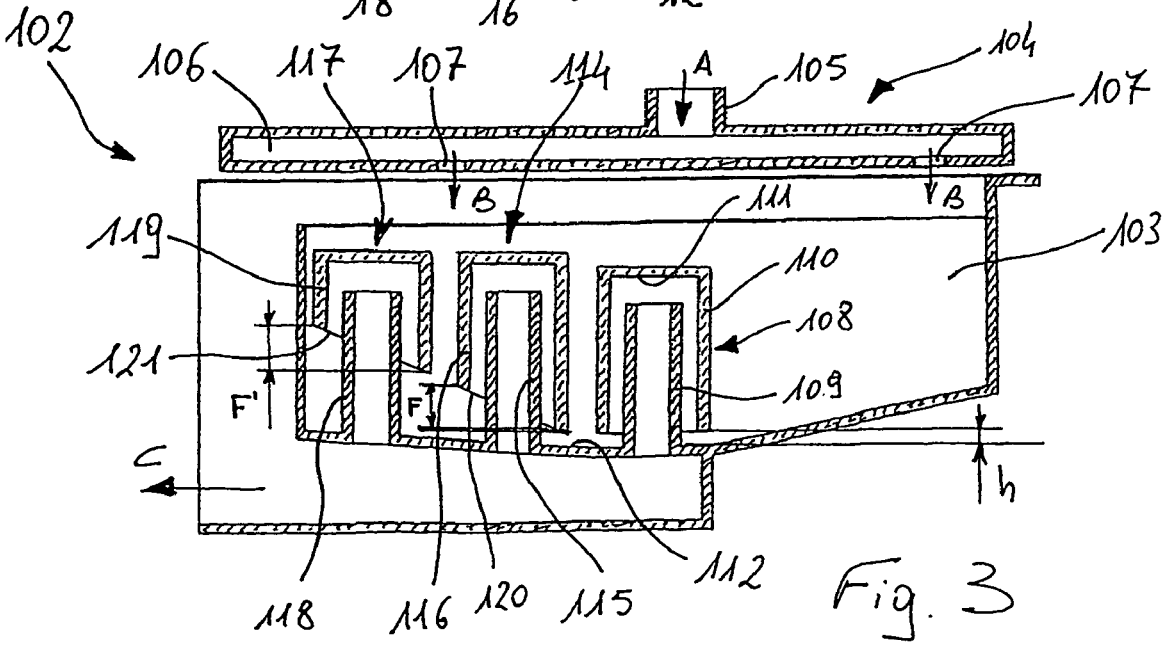
FIG. 3 is a view similar to the one illustrated in FIG. 2 of a second embodiment of a washing aid dispenser according to the present invention.

So, for instance, FIG. 3 can be noticed to illustrate a second embodiment of a washing aid dispenser 102 according to the invention, which comprises at least a compartment 103 that is adapted to receive and hold detergent substances and is in communication with water supply structure 104, with this water supply structure comprising a water inlet conduit 105, a chamber 106 and a plurality of apertures 107, through which water is able to flow into the dispenser 102 so as to mix with a detergent substance contained therein and then flow out of the dispenser and into the washing tub of the machine.

This washing aid dispenser further comprises a first siphon 108, which is similar to the first siphon 8 discussed above in connection with the first embodiment considered, and which therefore comprises a first conduit 109 that is open at both extremities thereof and is associated with a first cap piece 110 lying thereabove and defining a suction height h.

The washing aid dispenser 102 is additionally provided with at least a second siphon 114 comprising a second conduit 115 and a second cap piece 116, which cap piece has a base 120 that forms a pre-defined angle with respect to bottom 112 of the dispenser 102, whereby a suction height is thereby defined which is longitudinally variable along the dispenser 102, in such a manner as to substantially obtain a first suction zone F extending not only in a horizontal plane, but also in a vertical plane.

In an advantageous manner, the first suction zone F defined by the base 120 of the second cap piece 116 starts from a lower level that is equal to or slightly higher than suction height h of the first siphon 108 and continues with a pre-determined inclination. Furthermore, a height of a water head of the second siphon 114 will preferably be greater than that of the first siphon 108 and, possibly, even a diameter of the second conduit 115 may be selected to be larger than a diameter of the first conduit 109.

Advantageously, there may be further provided a third siphon 117 comprising a third cap piece 119 whose base 121 forms a pre-defined angle with respect to the bottom 112 of the dispenser 102, so as to define a second suction zone F' differentiated from and lying at a higher level than the first suction zone F defined by the second siphon 114.

It should be specially stressed how this second embodiment of the dispenser according to the present invention, further to achieving the afore-specified advantages, proves particularly efficient and advantageous as far as suction of a poorly homogeneous, stratified mixture is concerned. In fact, this particular configuration of the siphons enables a substantially continuous suction zone to be obtained, formed by the first and the second suction zones F and F' and covering substantially most of a height dimension of the dispenser 102. This is very effective in bringing about a sensible improvement in terms of suction capability of the siphons for a complete removal of both a water+aid mixture and any residue thereof from the dispenser itself.

It will of course also be appreciated that materials used to implement the dispenser of the present invention, as well as a shape, form and size of individual component parts thereof may be from case to case selected to most appropriately comply with particular needs and requirements without departing from the scope of the present invention.

The invention claimed is:

1. A washing machine comprising:

a washing aid dispenser; and a washing tub adapted to be supplied, through said washing aid dispenser, with a mixture of water and a washing aid, wherein said washing aid dispenser includes (i) a compartment adapted to contain the washing aid, (ii) a first siphon having a first suction height to draw-in and convey towards said washing tub a first layer of the mixture, (iii) a second siphon having a second suction height, greater than the first suction height, to draw-in and convey towards said washing tub a second layer of the mixture lying in said washing aid dispenser at a height greater than a height of the first layer of the mixture, and (v) a third siphon having a third suction height that is greater than the second suction height.

2. The washing machine according to claim 1, wherein said third siphon includes a conduit that is open at opposite ends thereof, and a cap piece situated above said conduit.

3. The washing machine according to claim 2, wherein a base of said cap piece forms an acute angle with respect to a bottom of said washing aid dispenser so as to define a suction zone having the third suction height as a variable suction height relative to the bottom of said washing aid dispenser.

4. The washing machine according to claim 3, wherein said second siphon includes a second conduit associated with a second cap piece situated above said second conduit, said second conduit being open at opposite ends thereof, with a base of said second cap piece forming an acute angle with respect to the bottom of said washing aid dispenser so as to define a second suction zone having a variable suction height relative to the bottom of said washing aid dispenser, with said suction zone associated with said third siphon being located at a greater distance from the bottom of said washing aid dispenser than is said second suction zone.

5. The washing machine according to claim 1, wherein a water head of said third siphon is to be higher than or equal to a water head of said second siphon.

6. A washing machine comprising:

a washing aid dispenser; and a washing tub adapted to be supplied, through said washing aid dispenser, with a mixture of water and a washing aid, wherein said washing aid dispenser includes (i) a compartment adapted to contain the washing aid, (ii) a first siphon having a first suction height to draw in and convey towards said washing tub a first layer of the mixture, said first siphon including a first conduit associated with a first cap piece situated above said first conduit, said first conduit being open at opposite ends thereof, and (iii) a second siphon having a second suction height, greater than the first suction height, to draw in and convey towards said washing tub a second layer of the mixture lying in said washing aid dispenser at a height greater than a height of the first layer of the mixture, said second siphon including a second conduit associated with a second cap piece situated above said second conduit, said second conduit being open at opposite ends thereof, and a base of said second cap piece forming an acute angle with respect to a bottom of said washing aid dispenser so as to define a first suction zone having said second suction height as a variable suction height relative to the bottom of said washing aid dispenser.

7. The washing machine according to claim 6, further comprising:

a third siphon including a third conduit associated with a third cap piece situated above said third conduit, said third conduit being open at opposite ends thereof, with a base of said third cap piece forming an acute angle with respect to the bottom of said washing aid dispenser so as to define a second suction zone having a variable suction height relative to the bottom of said washing aid dispenser, wherein said second suction zone is located at a greater distance from the bottom of said washing aid dispenser than is said first suction zone.

8. The washing machine according to claim 7, wherein said second suction zone has a lower level that substantially coincides with an upper level of said first suction zone, and extends with the same inclination as said first suction zone, in such a manner as to obtain a substantially continuous suction zone including said first and second suction zones.

9. A washing machine comprising:

a washing aid dispenser; and a washing tub adapted to be supplied, through said washing aid dispenser, with a mixture of water and a washing aid, wherein said washing aid dispenser includes (i) a compartment adapted to contain the washing aid, (ii) a first siphon having a first suction height to draw in and convey towards said washing tub a first layer of the mixture, said first siphon including a first conduit associated with a first cap piece situated above said first conduit, said first conduit being open at opposite ends thereof and having a first diameter, and (iii) a second siphon having a second suction height, greater than the first suction height, to draw in and convey towards said washing tub a second layer of the mixture lying in said washing aid dispenser at a height greater than a height of the first layer of the mixture, said second siphon including a second conduit associated with a second cap piece situated above said second conduit, said second conduit being open at opposite ends thereof and having a second diameter that is greater than said first diameter.

10. A washing machine comprising:

a washing aid dispenser; and a washing tub adapted to be supplied, through said washing aid dispenser, with a mixture of water and a washing aid, wherein said washing aid dispenser includes (i) a compartment adapted to contain the washing aid, (ii) a first siphon having a first suction height to draw-in and convey towards said washing tub a first layer of the mixture, (iii) a second siphon having a second suction height, greater than the first suction height, to draw-in and convey towards said washing tub a second layer of the mixture lying in said washing aid dispenser at a height greater than a height of the first layer of the mixture, and (v) a third siphon, with a water head of said second siphon to be higher than or a water head of said first siphon, and with a water head of said third siphon to be higher than a water head of said second siphon.

11. A washing machine comprising:

a washing aid dispenser; and a washing tub adapted to be supplied, through said washing aid dispenser, with a mixture of water and a washing aid, wherein said washing aid dispenser includes (i) a compartment adapted to contain the washing aid, (ii) a first siphon having a first suction height to draw-in and convey towards said washing tub a first layer of the mixture, (iii) a second siphon having a second suction height, greater than the first suction height, to draw-in and convey towards said washing tub a second layer of the mixture lying in said washing aid dispenser at a height greater than a height of the first layer of the mixture, and (v) a third siphon, with a water head of said second siphon to be higher than or equal to a water head of said first siphon, and with a diameter of said second siphon being greater than a diameter of said first siphon.

* * * * *